US006042691A

United States Patent [19]

Nitzman et al.

[11] Patent Number: 6,042,691

[45] Date of Patent: Mar. 28, 2000

[54] CATIONIC DISPERSIONS OF FORTIFIED AND MODIFIED ROSINS FOR USE AS PAPER SIZING AGENTS

[75] Inventors: Alan F. Nitzman, Pensacola, Fla.; Yosuhiro Morimoto, Hyogo, Japan

[73] Assignee: Plasmine Technology, Inc., Pensacola, Fla.

[21] Appl. No.: 09/207,590

[22] Filed: Dec. 8, 1998

[51] Int. Cl.[7] ..... D21H 17/62

[52] U.S. Cl. ..... 162/180; 162/164.1; 162/164.6; 162/179; 162/158

[58] Field of Search ..... 162/180, 164.1, 162/164.6, 164.3, 166, 168.2, 135, 158, 179; 106/218, 238

[56] References Cited

U.S. PATENT DOCUMENTS

| | | | |
|---|---|---|---|
| 2,995,483 | 8/1961 | Bonzagni . | |
| 3,102,064 | 8/1963 | Wurzburg . | |
| 3,130,118 | 4/1964 | Chapman . | |
| 3,186,900 | 6/1965 | De Young . | |
| 3,248,353 | 4/1966 | Coscia . | |
| 3,299,034 | 1/1967 | Nishiura . | |
| 3,526,524 | 9/1970 | Kulick . | |
| 3,526,542 | 9/1970 | Wiese, Jr. et al. . | |
| 3,565,755 | 2/1971 | Davison | 162/168.1 |
| 3,642,572 | 2/1972 | Endres et al. | 525/430 |
| 3,906,142 | 9/1975 | Dowthwaite et al. | 428/498 |
| 3,922,243 | 11/1975 | Aldrich et al. . | |
| 3,949,014 | 4/1976 | Maki et al. . | |
| 3,966,654 | 6/1976 | Aldrich | 162/180 X |
| 3,988,280 | 10/1976 | Aldrich et al. . | |
| 3,989,659 | 11/1976 | Aldrich et al. . | |
| 3,990,939 | 11/1976 | Aldrich et al. . | |
| 4,087,395 | 5/1978 | Aldrich et al. . | |
| 4,219,382 | 8/1980 | Leffler | 162/180 |
| 4,323,425 | 4/1982 | Dowthwaite et al. | 162/168.2 |
| 4,371,674 | 2/1983 | Hertel et al. . | |
| 4,522,686 | 6/1985 | Dumas . | |
| 4,540,635 | 9/1985 | Ronge et al. . | |
| 4,722,964 | 2/1988 | Chan et al. . | |
| 4,842,691 | 6/1989 | Nakajima et al. . | |
| 4,888,244 | 12/1989 | Masubuchi et al. . | |
| 4,943,608 | 7/1990 | Takahashi et al. . | |
| 4,983,257 | 1/1991 | Schultz et al. | 162/158 |
| 5,192,363 | 3/1993 | Bussell et al. | 106/218 |
| 5,393,338 | 2/1995 | Pudney et al. | 106/238 |
| 5,399,660 | 3/1995 | Uchida et al. . | |
| 5,401,562 | 3/1995 | Akao . | |
| 5,438,087 | 8/1995 | Ikeda et al. . | |
| 5,453,326 | 9/1995 | Siddiqui . | |
| 5,510,003 | 4/1996 | Colasurdo et al. | 162/158 |
| 5,567,798 | 10/1996 | Dulany et al. . | |
| 5,585,456 | 12/1996 | Dulany et al. . | |

OTHER PUBLICATIONS

Wu et al.., "Effects of Polyamine Structure on Rosin Sizing Under Neutral Papermaking Conditions," J. Of Applied Polymer Science, pp –21592163, Jan. 1997.

Zhuang et al., Neutral to Alkaline Rosin Soap Sizing with Metal Ions and Polyethyleneimine as Mordants, Tappi Journal, vol. 78, No. 4, pp. 155–161, Apr. 1995.

*Primary Examiner*—Peter Chin
*Assistant Examiner*—José A. Fortuna
*Attorney, Agent, or Firm*—Rothwell, Figg, Ernst & Kurz, p.c.

[57] ABSTRACT

A paper sizing agent is a rosin stabilized with a rosin-stabilizing amount of a cationic polyamidoamine-ethyleneimine-epichlorohydrin polymer resin, which is mixed with an aqueous dispersion containing paper pulp in a method for the production of paper.

12 Claims, No Drawings

CATIONIC DISPERSIONS OF FORTIFIED AND MODIFIED ROSINS FOR USE AS PAPER SIZING AGENTS

FIELD OF THE INVENTION

The invention relates to the field of rosins as sizing agents for paper products.

BACKGROUND OF THE INVENTION

In the past forty years or so, sizing agents have been sought that can be used in the neutral or alkaline pH range. Problems with paper making in the acid range where traditional rosin sizing agents have been used are well know, corrosion to the paper machine and browning and embrittlement of paper with age. Synthetic sizing agents alkenyl succinic anhydride (U.S. Pat. No. 3,102,064) and alkyl ketene dimer (U.S. Pat. No. 3,130,118) were developed for use under neutral and alkaline conditions. Rosin products are claimed to be useful at neutral or near neutral pH levels if they are made into cationic dispersions or if they employ modified rosins. Thus, U.S. Pat. No. 3,966,654 discusses cationic rosin emulsions, a specific example of which contains a water-soluble cationic aminopolyamide-epicholorhydrin resin, that were applied to pH 6.5. U.S. Pat. No. 4,943,608 discloses rosin emulsion sizing agents comprising fortified rosin, an at least partially quarternized product copolymer principally consisting of a (meth)acrylic acid alkylaminoalkyl ester or amide monomer and water. These products were tested to pH 6.8 in hand sheet sizing evaluations. U.S. Pat. No. 5,438,087 discloses rosin emulsions containing cationic acrylamide and/or methacrylamide polymers having hydrophobic groups. These products were tested at pH 7 with bleached kraft pulps and at unknown pH values with other pulps, used with retention aids.

Modifications to the rosin are disclosed in three U.S. patents. U.S. Pat. No. 4,540,635 discloses rosins that have been esterified with tertiary amino alcohol and also reinforced with formaldehyde and/or α,β-unsaturated carbonyl that are useful for neutral paper making. U.S. Pat. No. 4,842,691 discloses rosins reacted with at least one polyhydric alcohol selected from among a trihydric alcohol and a tetrahydric alcohol both consisting of carbon, hydrogen and oxygen, and useful at a pH of about 6 to about 9. U.S. Pat. No. 5,399,660 discloses rosins modified by being a diester and having a dicarboxylic acid or acid anhydride group or being modified with polyhydric alcohols, polybasic (tribasic or more) carboxylic acid or its anhydride and α,β-unsaturated polybasic acid or variants of these useful as neutral paper sizing agents.

SUMMARY OF THE INVENTION

In accordance with the present invention, a method is disclosed for the production of paper wherein a sizing agent is mixed with an aqueous dispersion containing paper pulp, and the pulp is thereafter formed into paper. The invention utilizes an improved sizing agent comprising a rosin stabilized with a rosin-stabilizing amount of a cationic polyamidoamine-ethyleneimine epichlorohydrin polymer resin.

DETAILED DESCRIPTION OF THE PREFERRED EMBODIMENTS

This invention relates to dispersions of rosins that are highly effective sizing agents for paper products. The dispersions are cationic in charge, and are derived from cationic resins found to be particularly effective in yielding a stable emulsion and good sizing. Dispersions of rosins or fortified rosins are highly effective when compared to dispersions made with other cationic resins.

The rosin size dispersions of this invention employ certain cationic resins to achieve high sizing efficiency as internal sizing agents for paper and can be applied over a wide pH range. Aqueous dispersions of modified rosins or rosin esters made with these cationic resins are more stable and have higher sizing efficiency under neutral conditions than from other cationic resins. Sizing is efficient over a wide pH range, from about 4 to 10. These dispersions are preferably applied at pH values of about 5.5 to 8.0. Dispersions of fortified rosins also have better emulsion stabilities. The cationic resins utilized in the invention are certain modified polyethyleneimines.

Aqueous dispersions of rosin materials stabilized with certain modified polyethyleneimines are particularly effective in sizing paper while at the same time providing excellent storage stability. When the rosin is modified by esterification with a polyhydric alcohol and a dicarboxylic acid or acid anhydride, or being modified with polyhydric alcohols, polybasic (tribasic or more) carboxylic acid or its anhydride and α,β-unsaturated polybasic acid, the resulting emulsion sizes are effective sizing agents over a wide range as previously indicated, from about 4 to about 10.

Modified polyethyleneimines are of the type described in U.S. Pat. No. 3,642,572. They are polyamidoamine-ethyleneimine-epicholorhydrin resins, and the ratio of ethyleneimene groups to dicarboxylic acid groups is preferably about four to eight, on a mole basis. Resins of this type are effective for paper sizing in the products of this invention and also in preparing and stabilizing aqueous dispersions. These resins are cationic, and retain moderate cationicity at neutral and alkaline pH values due to the amount of ethyleneimine groups which may explain why the products of this invention are so effective sizing agents. That the resins also contain amidoamine groups may explain why these cationic resins are so effective in stabilizing aqueous dispersions of rosin. Homopolymer polyethyleneimines and other grafted or modified polyethyleneimines do not seem to be useful as emulsifying agents; dispersions made from them are poor in particle size distribution and poor in stability, and therefore not useful as paper sizing agents. Blends of homopolymer polyethyleneimenes and aminopolyamide-epichlorohydrin polymers can attain the high sizing efficiency of the modified polyethyleneimines, but are not as effective in stabilizing dispersions at lower, and thus more economical, concentrations.

The sizing agents are made preferably by a high temperature homogenization process. In this way environmentally undesirable and expensive solvents of the well-known solvent process are avoided. And these compositions are difficult to invert, and can be inverted only when large amounts of cationic resin, which are expensive, are employed. We have found that the cationic resins used in this invention are very stable through the high temperature homogenization process whereas other cationic resins, such as polyamidoamines suggested in U.S. Pat. No. 3,966,654, degrade significantly, and result in more cationic resin being needed, and increasing the cost and decreasing the stability of the emulsion. The process of making a stable dispersion by the high temperature homogenization process is well known. A crude emulsion of the rosin product and the cationic resin and other additives, as such may be used, is made in a mechanical device which may be a centrifugal pump, mechanical disperser or colloid machine or other means of decreasing the particle size of the dispersed insoluble rosin. The final emulsion is then made in a high pressure device, such as a Gaulin homogenizer machine, from the APV Homogenizer Group, a Cherry-Burrell homogenizing machine, from Waukesha Cherry Burrell, or a Microfluidizer machine, from Microfuidics Corporation, at high temperature, e.g. 150° C. Any machine will do that yields particle sizes in the submicron range, small enough for good emulsion stability. The resulting emulsion is then quickly cooled and the pressure maintained high enough to prevent boiling of the water until cooling has taken place. Cooling is preferably done first by dilution so that temperature shock to the emulsion does not occur. Final cooling then takes place in a commercial heat exchanger such as a shell and tube or spiral heat exchanger.

EXAMPLES

The following examples are illustrative of this invention: In the examples PA-PEI refers to a polyamido-polyethyleneimine available from BASF Corporation under the trade name Polymin SKA or Lupasol SKA. In these examples, parts are by weight. Sizing results are determined on the Hercules Sizing Tester. The sizing test determines the resistance of a sized sheet of paper to penetration by usually No. 2 Test Solution, (an aqueous solution of, by weight, 1.0% formic acid and 1.25% naphthol Green B). The time necessary for ink penetration to reduce light reflectance to 80% of the sheet's initial value is used to represent the degree of sizing. In some cases, where sizing is very high, a stronger formic acid strength is used, 10%.

Example 1

This example shows the preparation of a dispersion that employs a modified rosin and a preferred formulation according to procedures and equipment useful on a practical or commercial scale. Tall oil rosin is modified according to U.S. Pat. No. 5,399,660 by reacting 9002 parts of rosin with 726 parts of propylene glycol and 1098 parts of maleic anhydride to yield, after loss of about 356 parts of water, 10,470 parts modified rosin.

Nitrogen gas was purged into the rosin reactor. Molten rosin was then added into the reactor, and heated to 180° C. Propylene glycol was then charged into the reactor, dropping the temperature to 155° C. The maleic anhydride was then added to the reactor. The resulting exothermic reaction carried the temperature to 200° C. Water began to come off at about 190° C., and was condensed in an overhead condenser. After two hours at 200° C., the temperature was raised to 260°, and maintained there for about 5 hours, and additional water was removed during this period. The modified rosin was then cooled. The modified rosin had an acid number of 126.5 and a ball and ring softening point of 90° C.

To 220 parts of PA-PEI resin, 37 parts of polyethylene glycol were added and 5200 parts water. The pH of this solution was adjusted to 3.5 using concentrated sulfuric acid. The polyethylene glycol had an average molecular weight of 1526, and was obtained under the trade name Carbowax PEG 1450 flake, from Union Carbide. The solution was then used with 3663 parts of modified rosin by the high temperature homogenization process to yield the final product. Defoamer consisting of treated silica in mineral oil, Discotech 5517 from Callaway Chemical Company, was added at 0.5 parts.

Example 2

This example shows the effect of pH of the aqueous phase on emulsion properties. A preparation was made in the lab using the same modified rosin as in example 1.302 parts of modified rosin was dissolved in 201 parts of methylene chloride solvent. 75.5 parts of an aqueous solution of PA-PEI were mixed with 422.8 parts of water and 6.0 parts of a 50% aqueous solution of polyethylene glycol, and the pH adjusted to 2.5 with concentrated sulfuric acid. The aqueous solution of PA-PEI was 24% resin and 76% water. The polyethylene glycol had an average molecular weight of 1450 and was obtained as Polyglycol E1450 from the Dow Chemical Company. The aqueous and solvent phases were then blended together in a Waring blender at low speed for two minutes. The mixture was homogenized in two passes in a laboratory Manton Gaulin homogenizer, model 15MR, at 7000 psig. The solvent was then stripped off at atmospheric pressure, and the dispersion cooled.

Example 3

This example shows the effect of pH of the aqueous phase on emulsion properties. A preparation was made according to the scheme of example 2 except that the pH was adjusted to 3.0 instead of 2.5.

Example 4

This example shows the effect of pH of the aqueous phase on emulsion properties. A preparation was made according to the scheme of example 2 except that the pH was adjusted to 3.5 instead of 2.5.

Example 5

This example shows the effect of pH of the aqueous phase on emulsion properties. A preparation was made according to the scheme of example 2 except that the pH was adjusted to 4.0 instead of 2.5.

Example 6

This example shows the effect of pH of the aqueous phase on emulsion properties. A preparation was made according to the scheme of example 2 except that the pH was adjusted to 4.5 instead of 2.5.

Example 7

This example shows the effect of pH of the aqueous phase on emulsion properties. A preparation was made according to the scheme of example 2 except that the pH was adjusted to 5.0 instead of 2.5.

Example 8

This example shows a product with more cationic resin. A preparation was made according to the scheme of example 2 except that the amounts were different, and that the pH was adjusted to 3.5 instead of 2.5. 217 parts of modified rosin was dissolved in 145 parts of methylene chloride. 114 parts of an aqueous solution of PA-PEI, 20% solids, were mixed with 468.8 parts water, and the pH adjusted to 3.5 with concentrated sulfuric acid. The dispersion was then prepared as in example 2.

Example 9

This example shows a dispersion product with no polyethylene glycol. A preparation was made in the lab using 228.6 parts of the same modified rosin as in example 1. The rosin was dissolved in 152.4 parts of methylene chloride. 57.1 parts of an aqueous solution of PA-PEI, 24% solids, were mixed with 514.3 parts water, and the pH adjusted to 3.0 with concentrated sulfuric acid. The remaining steps to prepare the dispersion were similar to those of example 2.

Example 10

This example shows a product with another type of modified rosin. The rosin was tall oil rosin modified with glycerine, trimellitic anhydride and maleic anhydride according to U.S. Pat. No. 5,399,660. 8.2 parts of glycerin were added to 87.9 parts of tall oil rosin at 180° C. Then the temperature was raised to 250° C., and maintained there until the acid number dropped to 40, about 4.5 hours. The temperature was lowered to 200° C., and 0.9 parts of trimellitic anhydride were added. The temperature was increased to 260° C. and held there for one hour. The temperature was lowered to 180°, and 7.0 parts of maleic anhydride were added. The exothermic reaction raised the temperature to 210° C. where it was maintained for two hours. Typical modified rosin properties were 100 to 110° C. ball and ring softening point and 70 to 80 acid number.

A preparation was made in the lab using 226.4 parts of this modified rosin. The rosin was dissolved in 151 parts of methylene chloride. 56.6 parts of an aqueous solution of PA-PEI, 24% solids, were mixed with 517 parts water, and 4.5 parts of a 50% aqueous solution of polyethylene glycol, and the pH adjusted to 2.5 with concentrated sulfuric acid. The polyethylene glycol was obtained as Polyglycol E1450 from the Dow Chemical Co. The dispersion was then prepared as in example 2. This dispersion is designated example 11A. A second dispersion was made from this modified rosin using the same formulation except the polyethylene glycol was omitted. This is designated example 10B. A third dispersion was made from this modified rosin using the ratio of 10.5% polyamidoamine/rosin instead of the ratio of 6% PA-PEI/rosin used for example 10A and example 10B, and omitting the polyethylene glycol. This dispersion is designated example 10C. The polyamidoamine resin used is available from the Callaway Chemical Co. under the trade name Discostrength 5807.

Example 11

This example shows a product with still another type of modified rosin. Tall oil rosin was reacted with glycerine according to the teachings of U.S. Pat. No. 4,842,691. 8.3 parts of glycerine was added to 88.7 parts of tall oil rosin at 180° C. The mixture was heated to 250° C. and maintained there for 6 hours. The acid number at this point was below 35. The temperature was lowered to 180° C. and 7.1 parts of maleic anhydride was charged.

A preparation was made in the lab using 226.4 parts of this modified rosin. The rosin was dissolved in 151 parts of methylene chloride. 56.6 parts of an aqueous solution of PA-PEI, 24% solids, were mixed with 517 parts water and 4.5 parts of a 50% aqueous solution of polyethylene glycol, and the pH adjusted to 3.5 with concentrated sulfuric acid. The polyethylene glycol was obtained as Polyglycol E1450 from the Dow Chemical Co. The remaining steps to prepare the dispersion were similar to those used in example 2. This dispersion is designated example 11A. Another dispersion was made using as the cationic resin the polyamidoamine and the ratio of 10.5% polyamidoamine/rosin as in example 10C. This dispersion is designated example 11B.

Example 12

This example shows a product with the preferred type of cationic resin used with fortified rosin. Tall oil rosin was reacted with fumaric acid for four hours at 200° C. in the ratio of 80 parts fumaric acid to 1000 parts rosin. A preparation was made in the lab using 226.4 parts of the fortified rosin. The rosin was dissolved in 151 parts of methylene chloride. 56.6 parts of an aqueous solution of PA-PEI, 24% solids, were mixed with 517 parts of water and 4.5 parts of a 50% aqueous solution of polyethylene glycol and the pH adjusted to 2.5 with concentrated sulfuric acid. The polyethylene glycol was obtained as Polyglycol E1450 from the Dow Chemical Co. The remaining steps to prepare a dispersion were similar to those used in example 2.

Example 13

This example shows a product with modified rosin and a useful, but not the most preferred, type of cationic resin. A preparation was made in the lab using the same modified rosin as in example 1. 217 parts of modified rosin was dissolved in 145 parts of methylene chloride. 152 parts of an aqueous solution of a cationic resin, 15% solids, were mixed with 430.8 parts water, and the pH adjusted to 3.7 with concentrated sulfuric acid. The cationic resin was polyethyleneimine modified by being reacted with epichlorohydrin, and available from BASF Corp. under the trade name Lupasol SC-86X. The dispersion was then prepared as in example 2.

Example 14

This example shows a product with a previously disclosed type of cationic resin. A preparation was made in the lab using the same modified rosin as in example 1. 22.99 parts of modified rosin was dissolved in 15.33 parts of methylene chloride. 6.03 parts of an aqueous solution of a cationic resin were mixed with 55.65 parts water, and the pH 3.1; it was not adjusted. The cationic resin was a polyamidoamine that is available from Callaway Chemical Co. under the trade name Discostrength 5821; Discostrength 5821 contains 40% solids. This type of cationic resin was disclosed in U.S. Pat. No. 3,966,654. The remaining steps to prepare the dispersion were similar to those in example 2.

Example 15

This example shows a product from fortified rosin and a previously disclosed type of cationic resin. Tall oil rosin was reacted with fumaric acid for four hours at 200° C. in the ratio of 92 parts fumaric acid to 1000 parts rosin. A preparation was made in the lab using 229.2 parts of this fortified rosin. The rosin was dissolved in 152.8 parts of methylene chloride. 114 parts of an aqueous solution of a cationic polymer were added to 468.8 parts of water. The remaining steps to prepare a dispersion were similar to those used in example 2. The cationic polymer was a polyamidoamine that is available from Callaway Chemical Co. under the trade name Discostrength 5809; Discostrength 5809 contains 20% solids. The cationic resin is chemically the same as that used in example 14.

Emulsion properties of examples 1 through 7 are shown in the following table. Viscosity is from Brookfield model DV-I+, and spindle LV 3 was used. Fall out is the amount of sediment accumulated on the bottom of a centrifuge tube after spinning a 50 g. sample with adjusted total solids at 1024 g forces for one half hour, pouring off the supernatant, rinsing the residue lightly with water and drying the residue at 105° C. for three hours. Fall out is the amount of residue, reported as a percentage of the dispersion solids. The solids of the samples used for fall out analysis were adjusted to 30% if the solids were above 30%, but not adjusted if the solids were 30% or lower. Fall out is a measure of the amount of over-sized particles, particles large enough to "fall out" of suspension to the bottom of a sample jar or storage tank. Fall out data indicate several examples have excellent stability. Higher pH solutions lead to poor emulsion quality.

| Example | Total Solids, % | Viscosity, cp | Fall Out, % | Turbidity, NTU | pH |
|---|---|---|---|---|---|
| 1 | 40.1 | 900 | 0.2 | 26.7 | 3.3 |
| 2 | 39.5 | 1317 | 0.3 | 24.0 | 2.7 |
| 3 | 39.6 | 1420 | 0.2 | 25.2 | 3.0 |
| 4 | 38.5 | 1545 | 0.2 | 26.3 | 3.4 |
| 5 | 38.6 | 2860 | 0.3 | 23.4 | 3.7 |
| 6 | 40.0 | 13,500 | 10.9 | 11.3 | 4.0 |
| 7 | 37.9 | 5120 | 27.1 | 10.3 | 4.3 |

Example 16

This example shows the advantage of the preferred cationic resin over polyamidoamine type for preferred rosin type, modified rosins. Dispersion prepared in example 9 was analyzed for fall out and value of 0.15% was obtained. Fall out of the dispersion prepared in example 14 was 1.19%. Hand sheets were prepared for testing of the sizing. Procedures used generally conformed to Tappi test method T 205 om-88 with the following exceptions: water was maintained at 40° C., sheets were pressed once for one minute at 60 psig, and drying was done in a laboratory drum drier for two minutes at approximately 138° C. Size and alum were diluted to 1% solutions and added by means of a micropipet. As appropriate, pH was adjusted with dilute sulfuric acid or dilute sodium hydroxide within seconds of start of the disintegration step. Alum was added at the one minute mark, and size at 1.5 minutes. Sheet was formed after 2.5 minutes. 5 lb/ton of size was used and 7.5 lb/ton of alum. The alum basis is defined according to the common practice in the paper industry as "dry" alum, actually with an average of 14 waters of hydration, $Al_2(SO_4)_3.14H_2O$. Unbleached kraft pulp was obtained from a paper mill producing paper bags. A Canadian Standard Freeness of 690 ml was measured. The following results were obtained.

| pH | Size | Formic Acid Conc. in Ink, % | HST, sec. |
|---|---|---|---|
| 5 | Example 14 | 10 | 184.7 |
| 5 | Example 9 | 10 | 320.1 |
| 5 | Example 1 | 10 | 296.8 |
| 6 | Example 14 | 10 | 255.6 |
| 6 | Example 9 | 10 | 342.3 |
| 6 | Example 1 | 10 | 366.8 |
| 7 | Example 14 | 10 | 180.4 |
| 7 | Example 9 | 10 | 341.0 |
| 7 | Example 1 | 10 | 384.1 |
| 8 | Example 14 | 1 | 489.3 |
| 8 | Example 9 | 1 | 1352.1 |
| 8 | Example 1 | 1 | 1589.4 |

Using the same pulp, hand sheets were made with sodium aluminate instead of alum. 5 lb/ton size was used, and 7.5 lb/ton of sodium aluminate was added. Basis of addition of sodium aluminate was as received, which was 43% solids, about 23.5% $Al_2O_3$.

| pH | Size | Formic Acid Conc. in Ink, % | HST, sec. |
|---|---|---|---|
| 8 | Example 14 | 10 | 89.2 |
| 8 | Example 9 | 10 | 134.3 |
| 8 | Example 1 | 10 | 134.1 |
| 10 | Example 14 | 1 | 90.9 |
| 10 | Example 1 | 1 | 132.0 |

Example 17

This example shows the advantage of the preferred cationic resin over a polyamidoamine for the preferred modified rosin using another pulp, pulp different from example 16. Hand sheets were prepared using bleached hard wood pulp and bleached soft wood pulp in the ratio of 60:40. Canadian Standard Freeness was 490 ml. Ground calcium carbonate was added; Omyafil grade from Omya, Inc. The pH was natural, and ranged from 7.8 to 8.0. Cationic starch was also added at a level of 10 lb/ton, at the half minute mark. The cationic starch was Cato 232, obtained from National Starch Co. Other procedures were generally as used in example 16.

| GCC Content, % | Size | Size Level, lb/ton | Alum Level, lb/ton | HST, sec. |
|---|---|---|---|---|
| 3 | Example 14 | 10 | 15 | 9.9 |
| 3 | Example 9 | 10 | 15 | 132.9 |
| 3 | Example 1 | 10 | 15 | 134.6 |
| 10 | Example 14 | 15 | 22.5 | 70.5 |
| 10 | Example 9 | 15 | 22.5 | 207.7 |
| 10 | Example 1 | 15 | 22.5 | 145.0 |

Example 18

This example shows the advantage of the preferred cationic resin over polyamidoamine type for another type of modified rosin, that which was discussed in example 10. Hand sheets were prepared using bleached hard wood pulp and bleached soft wood pulp in the ratio of 60:40. Canadian Standard Freeness was 490 ml. Precipitated calcium carbonate was used; this was Albacar HO grade from Specialty Minerals, Inc. Cationic starch was added at the level of 20 lb/ton. Cationic starch used was grade Cato 232 from National Starch Co. A cationic retention aid was added for some sheets. The retention aid used was Polymin 971L from BASF Corp. The addition order was: pulp and calcium carbonate at the beginning, retention aid, if added, at 0.5 min., alum, if added, at 1.0 min., size at 1.5 min., starch at 2.0 min., and the sheet was formed at 2.5 min. Size level was 15 lb/ton and starch level was 20 lb/ton for all sheets. Values of pH were natural, about 7.8 to 8.0. Other procedures were as used in example 16.

| Size | Alum Level, lb/ton | Retention Aid Level, lb/ton | HST, sec. |
|---|---|---|---|
| Example 10A | 20 | 0 | 100.7 |
| Example 10B | 20 | 0 | 153.8 |
| Example 10C | 20 | 0 | 69.6 |
| Example 10A | 0 | 0 | 70.0 |

-continued

| Size | Alum Level, lb/ton | Retention Aid Level, lb/ton | HST, sec. |
|---|---|---|---|
| Example 10B | 0 | 0 | 46.2 |
| Example 10C | 0 | 0 | 8.2 |
| Example 10A | 0 | 2 | 306.7 |
| Example 10B | 0 | 2 | 349.2 |
| Example 10C | 0 | 2 | 7.6 |

Example 19

This example shows that the preferred cationic resin used with modified rosin is effective over a wide pH range whereas fortified rosin is ineffective if the pH is too high. Hand sheets were prepared using bleached hard wood and bleached soft wood in the ratio of 60:40. Canadian Standard Freeness was 490 ml. Sodium aluminate was added for sheets made at pH 7.5 and it was added simultaneously with the size. Other procedures were similar to example 16.

| pH | Size | Size Level, lb/ton | Aluminum Ion Source | Amount, lb/ton | Formic Acid in Ink, % | HST, sec. |
|---|---|---|---|---|---|---|
| 4 | Example 12 | 7.5 | alum | 11.25 | 10 | 65.1 |
| 4 | Example 1 | 7.5 | Alum | 11.25 | 10 | 67.7 |
| 7.5 | Example 12 | 10 | sodium al. | 15 | 1 | 0.0 |
| 7.5 | Example 1 | 10 | sodium al. | 15 | 1 | 191.6 |

Example 20

This example shows the products of this invention size effectively over a wide range of pH and compare two types of modified rosins. Sizing was tested by hand sheets. Unbleached kraft pulp was obtained from a paper mill producing paper bags, and freeness of 690 ml measured, Canadian Standard Freeness. Size amount was 7.54 lb/ton and alum amount was 11.25 lb/ton. Other procedures were as used in example 16.

| pH | Size | HST, sec. |
|---|---|---|
| 7 | Example 1 | Over 1000 |
| 7 | Example 10A | Over 1000 |
| 8 | Example 1 | Over 1000 |
| 8 | Example 10A | Over 1000 |
| 9 | Example 1 | 129.5 |
| 9 | Example 10A | Over 1000 |
| 10 | Example 1 | 39.4 |
| 10 | Example 10A | 429.7 |

Example 21

This example shows sizing obtained with two types of modified rosins with various sources of aluminum ion or no aluminum ion. This example shows advantages in adding sodium aluminate simultaneously with the size. Hand sheets were prepared from pulp from old corrugated containers (OCC). Canadian Standard Freeness was 450 ml. All sheets were at pH 8.0. Various sources of aluminum ion were used, alum, sodium aluminate and polyaluminum chloride (PAC). PAC used was Gen$^{+}$Ion 7026. Order of addition of the aluminum ion source was tested; 0.5 minute before the size, simultaneously with the size or 0.5 minute after the size. Two sheets were made with no aluminum ion. 5 lb/ton size was used and 7.5 lb/ton of aluminum ion source. Other procedures were as used in example 16.

| Size | Alum. Ion Source | Alum. Position | HST, sec. |
|---|---|---|---|
| Example 1 | None | | 78.7 |
| Example 10A | None | | 39.4 |
| Example 1 | Sodium alum. | Before | 82.6 |
| Example 1 | Sodium alum. | Simultaneously | 220.2 |
| Example 1 | Sodium alum. | After | 159.5 |
| Example 10A | Sodium alum. | Before | 23.2 |
| Example 10A | Sodium alum. | Simultaneously | 85.5 |
| Example 10A | Sodium alum. | After | 40.8 |
| Example 1 | PAC | Before | 107.0 |
| Example 1 | PAC | Simultaneously | 59.2 |
| Example 1 | PAC | After | 72.2 |
| Example 10A | PAC | Before | 43.3 |
| Example 10A | PAC | Simultaneously | 26.2 |
| Example 10A | PAC | After | 31.2 |
| Example 1 | Alum | Before | 98.2 |
| Example I | Alum | Simultaneously | 51.1 |
| Example 1 | Alum | After | 71.6 |
| Example 10A | Alum | Before | 32.3 |
| Example 10A | Alum | Simultaneously | 18.7 |
| Example 10A | Alum | After | 28.5 |

Example 22

This example shows the advantage of the preferred cationic resin over polyamidoamine type for another modified rosin. Sizing was tested by hand sheets prepared from pulp containing hard wood and soft wood in the ratio of 60:40. Canadian Standard Freeness was 490 ml. 20% precipitated calcium carbonate was added; Albacar HO grade. 15 lb/ton of size and 20 lb/ton of alum were added. The pH was natural, about 7.8 to 8.0. Other procedures were as used in example 16.

| Size | HST, sec. |
|---|---|
| Example 11A | 284.9 |
| Example 11B | 106.4 |
| Example 10A | 445.4 |

Example 23

This example shows the benefits of PA-PEI cationic resin over polyamidoamine type for dispersions of fortified rosin. Fall out was measured for example 12 at 3.9% and for example 15 at 6.6%. Sizing was tested by hand sheets. Unbleached kraft pulp was obtained from a paper mill producing paper bags, and a freeness of 690 ml measured, Canadian Standard Freeness. Sheets were made according to procedures used in example 16. Results are for 10% formic acid ink. Size amount was 5 lb/ton, and alum 7.5 lb/ton.

| pH | Size | HST, sec. |
|---|---|---|
| 5 | Example 15 | 264.8 |
| 5 | Example 12 | 332.8 |
| 6 | Example 15 | 153.2 |

-continued

| pH | Size | HST, sec. |
|---|---|---|
| 6 | Example 12 | 290.8 |
| 7 | Example 15 | 45.9 |
| 7 | Example 12 | 113.9 |

Example 24

In this example the advantages of the preferred cationic resin over two other cationic resins are shown for modified rosin using the same level of cationic resin. Hand sheets were made using 60:40 ratio of bleached hard wood: bleached soft wood, Canadian Standard Freeness 550 ml. 7.5 lb size/ton and 11.25 lb/ton alum and 3% ground calcium carbonate were used. The pH was natural, about 7.8 or 7.9. Procedures used were similar to those used in example 16.

| Size | HST, sec. |
|---|---|
| Example 14 | 17.4 |
| Example 13 | 100.9 |
| Example 8 | 185.6 |

Example 25

This example shows the preparation of an emulsion using a blend of homopolymer polyethyleneimenes and an aminopolyamide-epichlorohydrin polymer. A preparation was made according to the scheme of example 2 except that the amounts were different and the pH was adjusted to 3.4 instead of 2.5. 217 parts of modified rosin was dissolved in 145 parts of methylene chloride. A total of 80.9 parts of cationic resins were dissolved in 501.9 parts of water. The cationic resins were 80% by weight of a aminopolyamide-epichlorohydrin polymer, Polymin SO, and 20% by weight of a polyethyleneimine homopolymer, Lupasol Waterfree. The dispersion was then prepared as in example 2.

Emulsion properties of examples 1 and 25 are compared in the following table. The data show that the emulsion quality of example 4 is better than example 25 although the amount of cationic resin is higher in example 25.

| Example | Calculated Cationic Resin/Rosin | Total Solids, % | Viscosity, cp | Fall Out, % | Turbidity, NTU | pH |
|---|---|---|---|---|---|---|
| 4 | 6.0 | 38.5 | 1545 | 0.2 | 26.3 | 3.4 |
| 25 | 10.5 | 28.2 | 16.2 | 2.70 | 25.4 | 3.2 |

Example 26

This example compares the sizing efficiency of product made with the PA-PEI cationic resin and a blend of a homopolymer polyethyleneimene and an aminopolyamide-epichlorohydrin polymer. Sizing was tested by hand sheets. Kraft pulp with a 60:40 ratio of bleached hard wood:bleached soft wood was used, Canadian Standard Freeness 435 ml. The pH was either adjusted to 5.5 or 7.0. Size amount was 8 lb/ton, and alum amount was 12 lb/ton. Sheets were made according to procedures used in example 16.

| pH | Size | HST, sec. |
|---|---|---|
| 5.5 | Example 1 | 570.4 |
| 5.5 | Example 25 | 673.6 |
| 7.0 | Example 1 | 262.4 |
| 7.1 | Example 25 | 466.5 |

The dispersions favored in this patent make good surface size agents.

We claim:

1. In a method for the production of paper wherein a sizing agent is mixed with an aqueous dispersion containing paper pulp, and the pulp is thereafter formed into paper, wherein the improvement comprises the use of a rosin stabilized with a rosin-stabilizing amount of a cationic polyamidoamine-ethyleneimine-epichlorohydrin polymer resin as the sizing agent.

2. The method of claim 1 wherein said resin has a ratio of ethyleneimene groups to dicarboxylic acid groups of about four to eight on a mole basis.

3. The method of claim 1 wherein said rosin is an esterified rosin.

4. The method of claim 3 wherein said esterified rosin has been esterified by an esterification agent selected from a group consisting of a mixture of a polyhydric alcohol and a dicarboxylic acid, a mixture of polyhydric alcohol and a dicarboxylic acid anhydride, a mixture of polyhydric alcohol, polybasic carboxylic acid and an unsaturated polybasic acid, and a mixture of a polyhydric alcohol, a polybasic carboxylic acid anhydride and an unsaturated polybasic acid.

5. The method of claim 3 wherein said sizing agent is effective over a pH range of from about 4 to 10.

6. The method of claim 5 wherein said sizing agent is effective over a pH range of from about 5.5 to 8.

7. The method of claim 1 wherein said sizing agent is an emulsion of said rosin and said cationic polymer resin.

8. The method of claim 1, wherein the weight ratio of said resin to said rosin is from about 1:9 to about 1:17.

9. The method of claim 8, wherein said weight ratio is about 1:16.6.

10. A mixture for forming into paper, comprising an aqueous dispersion containing paper pulp and a sizing agent which comprises a rosin stabilized with a rosin-stabilizing amount of a cationic polyamidoamine-ethyleneimine-epichlorohydrin polymer resin.

11. Paper sized with a sizing agent which comprises a rosin stabilized with a rosin-stabilizing amount of a cationic polyamidoamine-ethyleneimine-epichlorohydrin polymer resin.

12. Paper sized with a sizing agent which comprises a rosin stabilized with a rosin-stabilizing amount of a cationic polyamidoamine-ethyleneimine-epichlorohydrin polymer resin.

* * * * *

UNITED STATES PATENT AND TRADEMARK OFFICE

CERTIFICATE OF CORRECTION

PATENT NO. : 6,042,691

DATED : March 28, 2000

INVENTOR(S) : Alan F. Nitzman et al.

It is certified that error appears in the above-indentified patent and that said Letters Patent is hereby corrected as shown below:

Title Page:
The second co-inventor's name should be --Yasuhiro Morimoto--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*